US005151675A

United States Patent [19]

Biehl et al.

[11] Patent Number: 5,151,675

[45] Date of Patent: Sep. 29, 1992

[54] ELECTROMAGNETIC RELAY WITH A CONTACT SPRING MOUNTED ON AN ARMATURE

[75] Inventors: Wilfried Biehl; Bernhard Kleine-Onnibrink, both of Berlin, Fed. Rep. of Germany

[73] Assignee: Siemens Aktiengesellschaft, Munich, Fed. Rep. of Germany

[21] Appl. No.: 718,247

[22] Filed: Jun. 20, 1991

[30] Foreign Application Priority Data

Nov. 9, 1990 [DE] Fed. Rep. of Germany ... 901540[U]

[51] Int. Cl.[5] ..... H01H 51/22

[52] U.S. Cl. ..... 335/78; 335/83; 335/128

[58] Field of Search ..... 335/78-85, 335/124, 128, 129, 130

[56] References Cited

U.S. PATENT DOCUMENTS 2,253,142 8/1941 Seeley ..... 335/84
2,471,181 5/1949 Wilson ..... 335/80
4,509,028 4/1985 Mueller .
4,684,910 8/1987 Dittmann et al. .
4,935,544 6/1990 Mueller ..... 335/128

*Primary Examiner*—Lincoln Donovan
*Attorney, Agent, or Firm*—Hill, Van Santen, Steadman & Simpson

[57] ABSTRACT

A relay having a contact spring connected to an armature in which the contact spring is constricted near the free edge of the armature and is broadened into a T-shaped end to provide a double contact or bridge contact relay further includes supporting tabs applied to each of the transverse legs of the contact spring. The supporting tabs are struck by the armature during armature motion directed toward opening of the contacts. This transmits a jolt of force in the immediate proximity of the contact pieces during opening of the contact pieces in order to break any welding or adhesion of the contacts. The relatively weak spring modulus for ensuring closing of the contacts is retained.

6 Claims, 1 Drawing Sheet

ELECTROMAGNETIC RELAY WITH A CONTACT SPRING MOUNTED ON AN ARMATURE

BACKGROUND OF THE INVENTION

1. Field of the Invention

The present invention is directed generally to an electromagnetic relay having a leaf spring secured to the armature and carrying contacts on a portion of the spring extending beyond a free edge of the armature.

2. Description of the Related Art

Numerous type of relays are known including relays such as those disclosed in, for example, German Published Application 35 28 715 A1 or European Published Application 0 113 440 A1. The relays disclosed in these references are of an extremely simple design since there is a direct connection between the armature and the contact spring which avoids the use of an additional slide and wherein the contact spring frequently also provides the bearing and restoring force on the armature. These relays have two contact pieces on the free end of the contact spring and, thus, may be used as a bridge contact or as a double contact. The contact pieces are mounted on transverse legs on the free end of the contact spring which results from a constriction in the width of the contact spring between the fastening location of the contact spring on the armature and the transverse legs. This constriction causes the spring to have a soft spring characteristic, or low spring modulus, while at the same time allows for spring flex to compensate for variations in contact positions when switching.

Since double contact or bridge contact relays generally serve to switch higher currents, errors in relay switching and, thus, device outages may occur during use as a result of fusing or sticking of the contacts. The forces which act on so-called make-contacts through the contact spring when the armature drops off, or opens, may be inadequate under certain circumstances to pull apart slight welding or fusing of the contact surfaces. This is due to the opening forces of the armature being highly damped as a consequence of the susceptibility of the spring to flexing in both the longitudinal and transverse directions at the constriction. Thus, the opening forces are not fully transmitted to the adhered contact locations.

To avoid these disadvantages, either the spring restoring forces must be increased which in turn requires an increased excitation of the relay and, thus, a higher thermal load on the relay, or a relay of larger dimensions is required.

SUMMARY OF THE INVENTION

It is an object of the present invention to significantly diminish the effects of contact fusing in a relay having a contact spring of leaf spring materials secured on the armature in which the contact spring has a contacting end projecting beyond the free edge of the armature, the contact spring being of a diminished width in the region at the free end of the armature and being broadened to a T-shaped region extending beyond the armature edge to form two transverse legs, and contact pieces being situated on each of the transverse legs, without increasing the size of the contact and while still retaining the advantages achieved by the T-shaped spring.

This and other objects and advantages of the present invention are achieved by providing a supporting tab applied to each transverse leg extending in a direction for engagement with the free edge region of the armature during armature movement in a direction toward opening of the contacts. For the supporting tabs to have the desired effect, the free edge of the armature lies near the transverse legs of the contact spring so that the armature strikes the tabs to transmit a jolting force to the potentially adhered contacts.

By providing the supporting tabs according to the present invention, the flexibility and torsional rigidity of the T-shaped contact spring is fully preserved when closing the contact, while a jolting effect of the armature during opening of the contacts is applied immediately proximate to the contact pieces via the supporting tabs. This enables fused or adhered contacts to be opened when needed because the damping affect of the constriction in the flexible contact spring does not have affect in this case. It is assumed, of course, that the point of input between the armature edge and the supporting tabs lies sufficiently close to the contact pieces that the length of the supporting tabs and/or the section of the contact spring lying in this region does not experience any significant flexion.

To obtain a defined point of impact between the armature and the contact spring, it is expedient that the supporting tabs be formed as bent edge portions of the contact spring extending in the direction toward the armature surface. For the same purposes, however, it is also possible that the armature include relief or projection portions which are opposite the supporting tabs.

BRIEF DESCRIPTION OF THE DRAWINGS

The invention shall be set forth in greater detail below with reference to exemplary embodiments shown in the drawings.

DETAILED DESCRIPTION OF THE PREFERRED EMBODIMENTS

Figure 2:
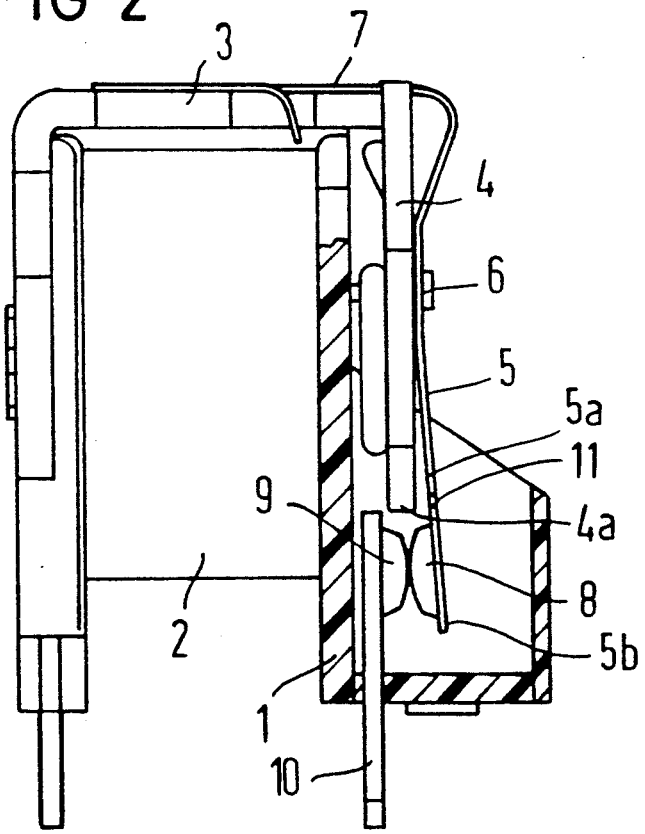
FIG. 2 is a side view, partially in cross section, of a relay having a relay spring formed as shown in FIG. 1.

A relay is shown schematically in FIG. 2 including a coil member 1 having a coil winding 2 to which is applied an angled yoke 3. A flat armature 4 is pivotably seated on the angled yoke 3 at the end of the winding 2. A contact spring 5 is riveted, welded or otherwise fastened to the armature 4 at a fastening location 6 and is secured on the yoke 3 by an arcuate, back bearing section 4.

Figure 1:
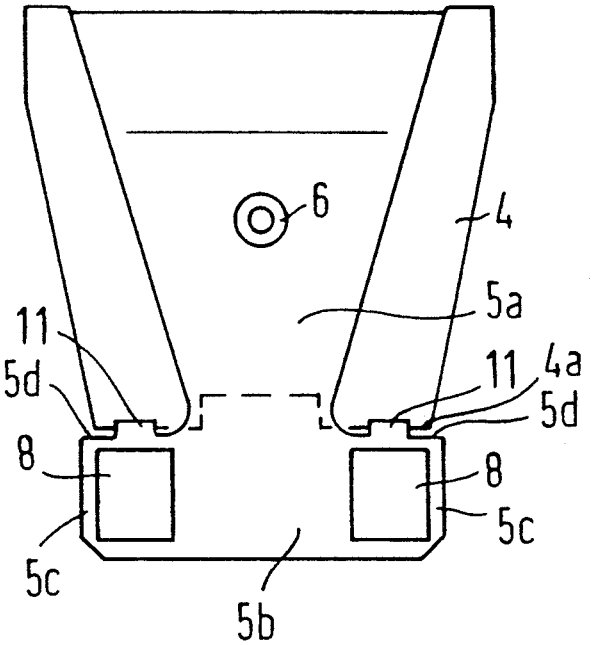
FIG. 1 is an end elevational view of an armature and relay spring of a relay according to the principles of the present invention.

As seen in FIG. 1, the width of the contact spring 5 is diminished in the region near the free edge 4*a* of the armature 4 and, thus, forms a constricted region 5*a* of reduced cross section. This reduction reduces the spring modulus and permits flexing and twisting to accommodate contact position. An end section 5*b* of the contact spring 5 is broadened into a T-shape extending beyond the free edge 4*a* of the armature 4 and thereby forms two transverse legs 5*c*. A contact piece 8 is secured on each of the transverse legs 5*c*. As may be seen in FIG. 2, the contact pieces 8 work in conjunction with contact pieces 9 of a cooperating contact element 10 in the relay. The contact spring along with two cooperating contact elements 10 (only one of which is visible in FIG. 2) either form a bridge contact or a double contact, depending upon whether the two cooperating contact elements 10 are connected in parallel or in series with a load circuit. In the case of a double contact, of course, the contact spring 5 must have its own terminal.

As a result of the reduction in cross section of the contact spring 5 in the region 5*a*, the contact spring may easily flex as well as twist along its longitudinal axis when the contacts are closed to compensate for tolerance variations with respect to the cooperating contact elements 10. This thereby provides a uniform contacting pressure between the contact pieces 8 and 9.

When the contact pieces 8 and 9 are opened, however, it is undesirable to damp the armature opening force with this easily flexed contact spring, since a slight welding or adhesion between the contact surfaces may resist opening and would then require a jolt or impact to pull the contacts apart. Thus, according to the present invention, the two transverse legs 5*c* of the contact spring 5 are each provided with an applied supporting tab 11 at an upper edge 5*d*, which is the edge opposite the free edge 4*a* of the armature 4. The supporting tabs 11, which in the first embodiment lie in the plane of the contact spring 5, enter into engagement with the free edge 4*a* of the armature 4 during opening motion of the armature. As may be seen in FIG. 2, a slight gap is present between the free edge 4*a* of the armature 4 and the constricted portion 5*a* of the contact spring 5 when the contacts 8 and 9 are closed so that the initial opening movement of the armature 4 builds momentum before the armature edge region strikes the supporting tabs 11. This impact transmits an abrupt jolting force to the contacts to break apart any welds and to ensure opening of the possibly fused contacts 8 and 9.

The upper edge 5*d* of the spring end section 5*b* is preferably immediately adjacent the armature free edge 4*a*, since in a significant distance therebetween would result in damping of the armature impact due to the length of the supporting tabs 11 required to contact the armature edge 4*a*. Thus, the preferred embodiment has short supporting tabs 11 for striking contact between the contact spring 5 and the armature 4 so that the forces are transmitted directly to the contacts 8 and 9. Of course, other arrangements which transmit a jolting force to the contacts are also possible.

Figure 3:
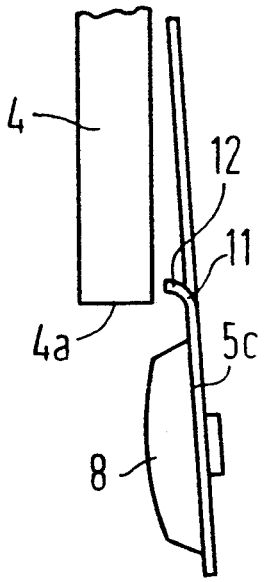
FIG. 3 is an enlarged side view of a free end region of a relay armature and a contact spring according to a second embodiment of the invention.

A second embodiment is shown in the enlarge, detailed view of FIG. 3, in which the supporting tabs 11' have an end section 12 which is bent off toward the armature free edge region 4*a*. This bent end 12 of the supporting tabs 11 forms a defined detent, or point of impact, in the armature motion. It is, of course, possible to provide alternate shapes and type of projections extending from the contact spring 5 toward the armature 4.

Figure 4:
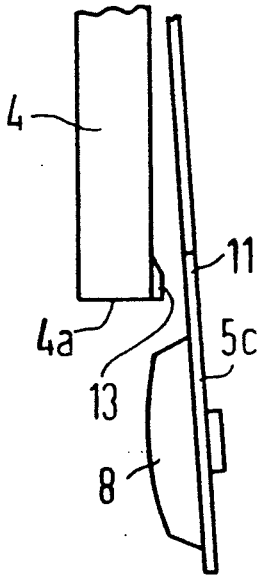
FIG. 4 is an enlarged side view of the armature and contact spring of yet another embodiment of the invention.

In FIG. 4, an embodiment of the invention is shown in which a relief embossment 13 is provided on the surface of the armature 4 opposite each of the supporting tabs 11 to provide the detent as in the embodiment of FIG. 3. When such projections 13 are provided on the armature 4, the supporting tabs 11 may either lie in the plane of the contact spring 5 as shown in FIGS. 1 and 2 or may be bent as in the embodiment of FIG. 3. The embodiments of FIGS. 3 and 4 permit the armature 4 to strike the supporting tabs 11 first before reaching the rest of contact spring 5 so that none of the jolting force is dissipated.

The supporting tabs, of course, may also contain other shaped portions, such as leads or the like to affect a stiffening of the tabs 11.

The illustrated embodiment shows a make-contact relay. This means that the contact opening occurs during the drop-off motion of the armature 4 and that the supporting tabs 11 strike on the side of the armature 4 facing away from the end of the coil winding 2. It is also contemplated to modify the present invention for use with break-contact relays in which the opening of the contacts occurs during attraction of the armature 4 toward the end of the winding 2. In this case, the supporting tabs 11 would have to strike the armature surface facing toward the winding 2.

Although other modifications and changes may be suggested by those skilled in the art, it is the intention of the inventors to embody within the patent warranted hereon all changes and modifications as reasonably and properly come within the scope of their contribution to the art.

We claim:

1. An electromagnetic relay, comprising:

a coil;

stationary contacts mounted in said relay;

an armature mounted for movement at an end of said coil about a pivot edge, said armature having a free edge;

a contact spring of leaf spring material secured to said armature to bias said armature toward a predetermined position, said contact spring having a contact end extending beyond said free edge of said armature, said contact spring being of a reduced width in a region adjacent said free edge of said armature and having a broadened portion extending beyond said free edge to form two transverse legs;

two contact pieces mounted on respective ones of said transverse legs, said contact pieces being movable into contact with said stationary contacts to define a closed position and alternately out of contact with said stationary contacts to define an open position upon movement of said armature by alternate application and discontinuation of electromagnetic forces by said coil; and supporting tabs on respective ones of said transverse legs of said contact spring, said supporting tabs extending from said transverse legs for contact with said armature in a region adjacent said free edge upon movement of said armature in a direction to move said contact pieces from said closed position to said open position, said supporting tabs comprising edge sections of said contact spring which are bent toward said armature.

2. An electromagnetic relay, comprising:

a coil;

stationary contacts mounted in said relay;

an armature mounted for movement at an end of said coil about a pivot edge, said armature having a free edge;

a contact spring of leaf spring material secured to said armature to bias said armature toward a predetermined position, said contact spring having a contact end extending beyond said free edge of said armature, said contact spring being of a reduced width in a region adjacent said free edge of said armature and having a broadened portion extending beyond said free edge to form two transverse legs;

two contact pieces mounted on respective ones of said transverse legs, said contact pieces being movable into contact with said stationary contacts to define a closed position and alternately out of contact with said stationary contacts to define an open position upon movement of said armature by alternate application and discontinuation of electromagnetic forces by said coil; and supporting tabs on respective ones of said transverse legs of said contact spring, said supporting tabs extending from said transverse legs for contact with said armature in a region adjacent said free edge upon movement of said armature in a direction to move said contact pieces from said closed position to said open position; and wherein said armature includes relief portions opposite said supporting tabs and extending toward said supporting tabs, said relief portions being engageable with said supporting tabs during movement of said armature toward the open position.

3. A contact spring assembly for mounting on a coil of an electromagnetic relay, comprising:

an armature pivotably mounted at an end of the coil for movement between first and second positions about a pivot axis, a free edge of said armature being remote from said pivot axis;

a leaf spring member mounted on the coil and affixed to the armature to bias said armature toward one of said first and second positions, said leaf spring having a contact mounting portion extending beyond said free edge of said armature, said contact mounting portion being of greater width than a portion of said leaf spring member adjacent said free edge of said armature;

at least one contact mounted on said contact mounting portion of said leaf spring and adapted for contacting a stationary contact of the relay when said armature if in said first position; and means for jolting said contact mounting portion of said leaf spring member during movement of said armature from said first position toward said second position by abrupt contact with said free edge of said armature against an opposing portion of said leaf spring member, said means for jolting comprising a projection on one of said armature and said leaf spring member and extending toward the other of said leaf spring member and said armature.

4. A contact spring assembly as claimed in claim 3, wherein said means for striking comprises a projection on said leaf spring member extending toward a region of said armature adjacent said free edge.

5. A contact spring assembly as claimed in claim 4, wherein said projection is an edge of said leaf spring member bent to extend toward said armature.

6. A contact spring assembly as claimed in claim 3, wherein said means for jolting comprises a projection on said armature adjacent said free edge and extending toward said leaf spring member.

* * * * *